US006793552B2

(12) United States Patent
Derrah

(10) Patent No.: US 6,793,552 B2
(45) Date of Patent: Sep. 21, 2004

(54) RADIO CONTROLLED SURFBOARD WITH ROBOTIC RIDER CONTROLLED BY TWO-STRING ROTO-WING

(76) Inventor: Steven J. Derrah, 726 Park Ave., Portsmouth, RI (US) 02871

( * ) Notice: Subject to any disclaimer, the term of this patent is extended or adjusted under 35 U.S.C. 154(b) by 0 days.

(21) Appl. No.: 10/325,119

(22) Filed: Dec. 20, 2002

(65) Prior Publication Data

US 2004/0121700 A1 Jun. 24, 2004

(51) Int. Cl.[7] ..... A63H 23/04; A63H 30/00

(52) U.S. Cl. ..... 446/154; 446/156; 446/164; 446/457

(58) Field of Search ..... 446/153, 154, 446/156, 163, 164, 275, 457

(56) References Cited

U.S. PATENT DOCUMENTS

| | | | | | |
|---|---|---|---|---|---|
| 4,923,427 | A | * | 5/1990 | Roland | 446/153 |
| 5,947,788 | A | * | 9/1999 | Derrah | 446/154 |
| 6,074,271 | A | * | 6/2000 | Derrah | 446/457 |
| 6,183,333 | B1 | * | 2/2001 | Hall | 446/154 |
| 6,315,630 | B1 | * | 11/2001 | Yamasaki | 446/275 |

* cited by examiner

*Primary Examiner*—Derris H. Banks
*Assistant Examiner*—Ali Abdelwahed
(74) *Attorney, Agent, or Firm*—Cristina M. Offenberg, Esq.

(57) ABSTRACT

A radio controlled toy is provided with a robotic rider that catches waves via an electric motor and propeller, then rides waves like a real surfer, and rights itself after a wipeout comprising a novel way to rotate the robotic rider's upper torso and to disburse the motor room heat allowing for long run times.

10 Claims, 4 Drawing Sheets

10
19
37
17
12
38

10
19
11
12
18
17
21
32
34
33
36
35
39

10
21

10
32
34
33
36
35
36

RADIO CONTROLLED SURFBOARD WITH ROBOTIC RIDER CONTROLLED BY TWO-STRING ROTO-WING

FIELD OF INVENTION

The present invention relates to a radio controlled surfboard having a motorized robotic rider in the nature of a toy or amusement device wherein the robotic rider is controlled by a two-string roto-wing.

BACKGROUND OF INVENTION

The present invention was designed to imitate the act of surfing as close as possible to real life surfing via a remote controlled surfboard in an effort to generate the realism and excitement in order to be marketable to surfers and surfboard enthusiasts. The present invention is a toy motorized surfboard with a robotic rider, designed to perform almost every maneuver from all the different aspects of human surfing. The result is an easily maneuverable, directional toy that handles with enough precision to host a new competitive radio control sport.

The applicant has two patents on radio controlled toys. The surfboard patent (hereinafter Derrah '88) had some difficulties in operation. First, the motor room was overheating and the run time was stifled due to the number of batteries in the compartment and small size of the compartment. The new invention includes an aluminum heat sink device via an aluminum keelson to cool the motor. The aluminum heat sink expels motor room heat out into the ocean, pool or pond. This modification allows the surfboard to work properly for a longer time. Second, the weight of robotic figurine in the prior invention was too heavy due to the presence of a servo in the robotic figurine's back. The applicant has improved upon these short comings in the present invention. In contrast to the prior art, the present invention has a robotic rider controlled by a two string roto-wing, which eliminates the need for the servo in the back of the figurine. The upper body of the robotic rider has been made lighter by removing the servo and reducing the number of joints in the prior figurine. The rider needs to be lighter in order to properly and efficiently right the surfboard after capsizing. Also, in an effort to imitate real surfing, the size of the board relative to the size of the rider can be maintained by reducing the weight of the rider. The new surfboard includes a small rudder and two side fins used to steer the surfboard.

SUMMARY OF THE INVENTION

The need for motor room cooling for electric powered radio-controlled vehicles is as old as battery power itself. Cars and planes can rely on air cooling without consequence. However boats have to be careful of taking in water when trying to pass air by the motor and batteries. Boats usually rely on the combination of a water-cooling coil surrounding the motor; and a dry air venting system to expel the hot air that builds up in a typical battery powered engine room. The venting system being the most effective method. However, the typical radio-controlled motor room cooling coil system fails to adequately cool the tremendous amount of heat created from a big cell battery pack that is located right next to a high RPM electric motor. In a radio controlled toy, the cooling coil's diameter is too small and the volume of water traveling through the coil tubes is at a trickle and therefore not adequate for cooling purposes. Other problems include: air void problems and the potential of debris blockage. Despite the cooling coil's faults, most remote controlled toy boats make-out okay with them; especially the larger ones, because the engine rooms are big; with high ceilings and vents to expel the intense motor room heat.

In the radio-controlled surfboard, there is no chance for the air to pass in or out of the motor room due to its small size. Also, when the waterproof deck is screwed shut neither air or nor water can penetrate it. It is necessary to have the deck screwed shut due to the fact that the surfboard is more or less under water like a submarine and must be water tight.

The typical problem found when running radio-controlled surfboard is that run-time is stifled by overheating of the motor. This is especially true with the new high capacity, long running nicad cells batteries and metal hydride battery cells between 2400 MHZ and 3000 MHZ. These batteries are capable of running at high speed at full throttle for ten minutes or more. However the same batteries run in a remote controlled toy surfboard give about five minutes of high speed at full throttle and three minutes of slow speed at full throttle; and this is with the assumption that it starts out with a stone cold motor.

This sport of radio-controlled surfing is not advancing if you only get five minutes or less run time. Additionally, after the motor overheats, the board and rider need to be taken out of water, dried off, unscrew and have the deck removed; and then wait thirty minutes for the motor to cool, or in the alternative; to change both motor and batteries every time it runs. The prior art radio-controlled surfboards would overheat catch fire, melt a hole in the hull and sink before you would get forty-five minutes in the water running. There was a need for a change to allow for motor cooling and prevention of overheating. The present invention addresses these short comings by providing a cooling system by way of the heat sink aluminum keelson. This new heat sink keelson design will be able to take advantage of the long run batteries of the future.

The other problem with the pre-existing surfboard toy is that it does not right itself automatically. The shortcomings of that invention was that the user needed the assistance of an on-coming wave and or dramatic body movements back and forth to right the surfboard. The keelson design combined with the new-age heat sink motor and battery mount accomplishes a righting moment. It provides some ultra low profile keel ballast useful in righting the surfboard.

There are many different ways to make a robotic rider's upper torso twist from port to starboard and vise versa. Some of these are outlined in the Derrah '88. No prior art in the radio control surfing industry has surfaced that is as simple, inexpensive, and lightweight as the present invention of a two string roto-wing.

This new design is an improvement upon the Derrah '88, Radio-Controlled Surfboard with Robot. The robotic movements of a rider on a surfboard deck continue to be carried out in this new design. As disclosed in the prior patent, body movement #2—the upper torso movement and body movement #1 the movement of the lower body over the deck of the surfboard, both are controlled with the novel roto-wing. However, body movements #3 and #4 outlined in Derrah '88 and Derrah '71, a skateboard patent # 6,074,271 are eliminated with this new design. The two string-roto wing makes a big change in body movement #2. The body movement #1 is used and it remains essentially the same as in Derrah '88—FIG. 4 with the difference being that the leg connector is attached directly to the front leg, as opposed to a relay mill connecting to the rear foot.

In this remote controlled toy in marine use, there is a need for the robot's upper torso to be ultra lightweight so the surfboard and rider can right itself after a wipeout without adding too much keel weight or increasing the size of the surfboard. This new design of a two-string roto-wing provides a simply, inexpensive and corrosion free solution.

The wing shaped servo arm named roto-wing, pulls two lines, port string and starboard string that work in-sync to twist the robotic rider's upper torso. One string pulls as the other lets go and vice versa. Because the roto-wing is part of the body movement branch; when the body moves, the wing moves, so in turn the upper torso twists. This new design is similar to Derrah '88 (as shown in that patent in FIG. 23, FIG. 24, FIG. 25), but without the servo and roto-wing outside the surfboard providing more movement. The replacement of the roto-wing eliminates the need for the servo in the back of the rider making the rider lighter in weight and allowing the surfboard and rider to right itself easily after a wipe-out.

The two strings of the roto-wing are made with clear fishing line that is virtually invisible from a ten-foot distance. The port string travels from the port knot through a hole at the port end of the roto-wing down through the port deck guide then travels up through the port waist guide at the right side of the robotic rider's waist. The same sequence takes place on the starboard side. Both the port string and starboard string are tied to the center arm loop. The center arm loop sticks out from the rider's arm, and is preferably made of stainless steel wire but can be of any material that can be secured into the rider's arm and hold the string secure, and the length and placement is critical to centering the upper torso.

The two string pulling action of the roto-wing can be seen in FIGS. 8, 9, and 10 by comparing string travel. These two body movements #1 and #2 really make radio controlled surfing an intense and exciting adventure. The realism achieved by the robotic movements of the rider gives the impression that the rider is real, and is really responsible for steering the surfboard by thrashing its body about and seeing the surfboard respond. The other advantage is that the rider in the act of leaning its weight over the surfboard sinks the affected rail of the surfboard deep into the wave, which enables the surfboard to take advantage of the many pockets of energy present in all breaking waves; especially top to bottom barreling waves. This recreated movement is the same way a real surfer propels himself on real waves—weighting and un-weighting at the right times. When a rider sinks a rail at the apex of a turn at the same time he is at the trough or bottom corner of a wave; where the water is sucking up the facer of the wave; the rider accelerates out of that pocket of the wave like a rocket doubling or tripling his speed. The "real surfing" situations are possible to be created with this robotic rider because the rider is able to lean out, over and sink a rail; like real surfers. The fact is that 70% of the steering is done by the rudder and 30% of the steering is done by the rider leaning over the surfboard. In comparison to rail sinking where 10% of the rail sinks by rudder and 90% of the rail sinks by the rider's body hovering over the surfboard rail. This robotic rider and surfboard turns amazingly tight and smooth when carving. This combination of a rudder turning in sync with a rider's body movement was claimed in Derrah '88, but with a jet steering nozzle instead of a rudder; and has now been proven to be the ultimate way to run a remote control surfboard. With this design, the rider's body movements assist steering to a degree where it does not require a real deep or twin deep rudder to turn this surfboard and rider sharply; or even on its length, this design allows a smaller rudder therefore it can run in shallower water without breaking off a rudder. Additionally, if the rudder did break off, a user can still steer it home with the assistance of the towed-in side fins combined with the body movement.

BRIEF DESCRIPTION OF DRAWINGS

FIG. 5 is a bottom view of the surfboard hull and keelson

DETAILED DESCRIPTION OF THE DRAWINGS

The electrical connections or wires are not shown in any drawings. It is assumed that all parts are connected to each other by the proper wiring provided with each component. All like components are labeled with the same identifying numbers.

FIG. 1

Figure 1:
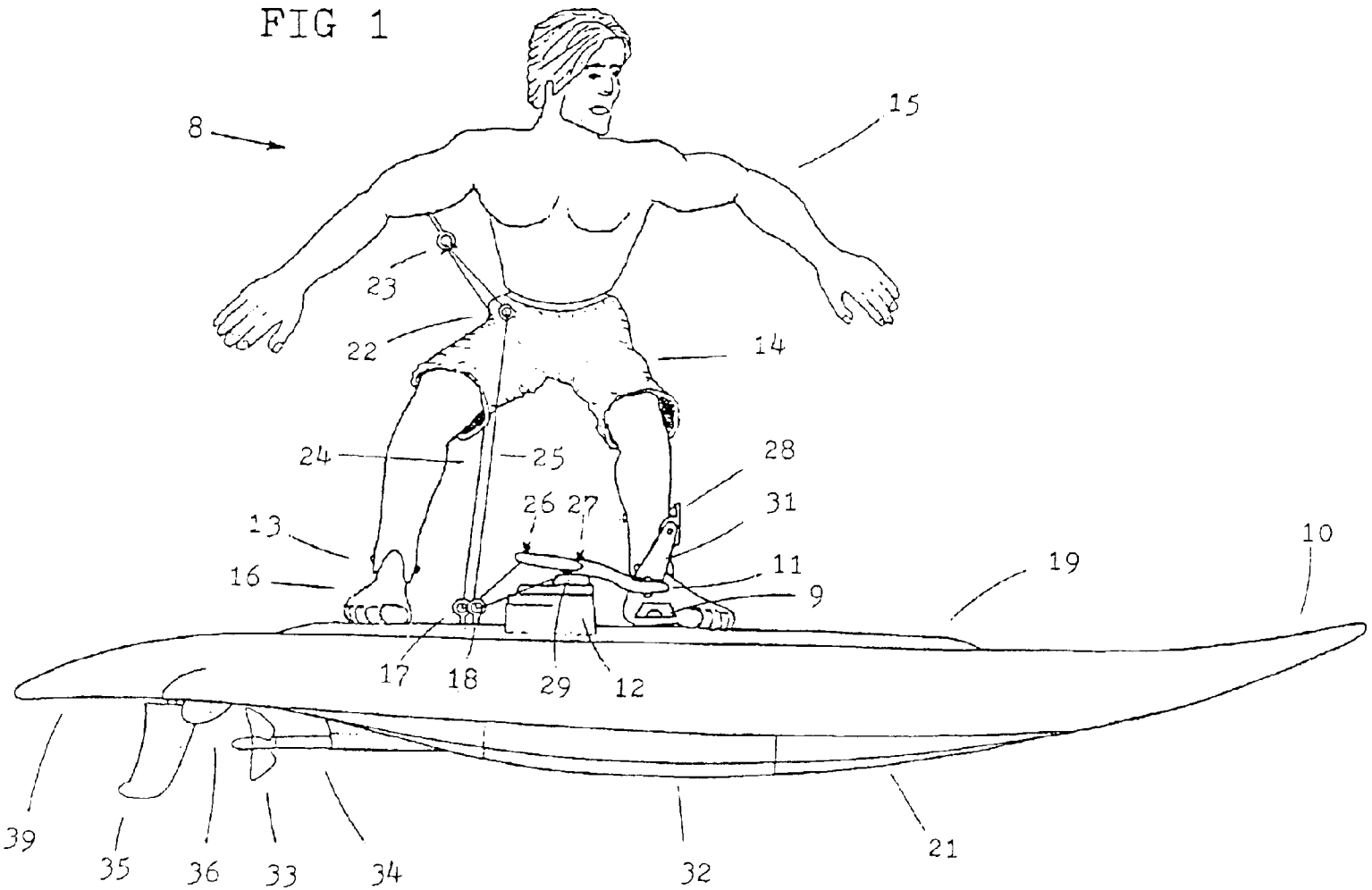
FIG. 1 is a front view of the robotic rider on the remote controlled surfboard

FIG. 1 shows a front view of the moveable robotic rider 8 and the starboard side of the radio controlled surfboard 10. The robotic rider's upper torso 15 is shown with arms straight out, fore and aft over the radio controlled surfboard 10 in a center balanced "go straight" position. The upper torso 15 is molded in a one piece foam filled lightweight part that includes the head and arms pre-set at the correct tilt and forward moving look of a balancing professional surfer. Because the upper torso 15 stands highest off the deck 19, it is vital that it be ultra light weight so the righting moment occurs quickly to allow the surfboard 10 and robotic rider 8 to get up and out of the impact zone before the next wave rolls through and knocks them over.

The upper torso 15 is moveable as it twists from center to port, and back; then from center to starboard and back from port straight over to starboard and vice versa. This is shown as body movement #2; (shown in drawing FIGS. 8, 9 and 10) and as originally outlined in Derrah '88 patent. The Derrah '88 patent actually claimed two different methods to activate body movement #2, one was a mini servo placed in the rider's back; the other involved strings being pulled from a servo within the surfboard, shown in Derrah '88 in FIG. 23, FIG. 24, and FIG. 25. This claimed design did not offer enough upper body movement and was not designed to work with body movement #1. The skateboard patent, Derrah '71 which claimed a third method to activate body movement #2 (shown in FIG. 7, FIG. 18, and FIG. 19 of that patent) also has been improved upon. In the skateboard patent, there is a spring-rotor in the rider's back that will not work in water because of corrosion. The fourth and best method of activating body movement #2 for a surfboard is outlined and claimed in this patent application. The novel method is called the two-string roto-wing 11. It is explained in detail in FIG. 8, FIG. 9, and FIG. 10.

Body movement #2 helps the surfboard lean into turns and also gives the rider 8 an added touch of realism. Surfing along as the rider's 8 turned head and the leading arm swings into turns laying the surfboard 10 way over, carving and making the rider 8 look like it is really working at it like a real surfer and as it rips front and backhand turns.

The lower body 14 is seen molded in a crouched position, attached in a regular foot stance (left foot forward), as the two molded feet, left foot 9 and right foot 16 are hinged at ankle 13. The lower body 14 is attached to the upper torso 15 by a swiveling axis connector 30.

The lower body 14 carries the upper torso 15 to perform body movement #1. This is the body movement that puts the most weight over port, center or starboard of the surfboard 10.

The lower body 14 is molded in one piece. The lower body 14 is foam filled with a hard plastic outer surface with a female bay for wrench access to service the axis connector 30 (not shown). It is less critical that the lower body 14 be ultra lightweight because it is not as high over the surfboard 10. Yet, the combined weight of the upper torso 15 and the lower body 14 have to carry a substantial amount of weight in order to lean the surfboard 10 over which seems to work out okay because the combined weight of the lower body 14 and the upper torso 15 accumulated some extra ounces in the course of making them strong enough to withstand a big wave ocean beating.

The correct amount of weight of the rider 8 is determined by a flat water float test. By putting the rider 8 in a full front or backhand turn, the rider's 8 upper torso 15 and lower body 14 will touch the water but will not tip the surfboard 10 over. When in this position, the operator can let go of the controls, which brings the rider 8 back to center; wait a few seconds and the rider 8 rights itself automatically. Additionally, the operator can signal the rider 8 to move to the opposite side of the surfboard 10 for almost instant recovery. This same type of recovery action was mentioned in Derrah '88, and shown in FIG. 19A, however this new art and rider recovers much quicker on its own and does not need an oncoming wave to right it as disclosed in Derrah '88. The new art uses a keelson design combined with the new-age heat sink motor and battery mount to expel heat and assist in this righting movement. Body movement #1 is possible because of the high torque servo 12 near the base of the rider's 8 left foot 9. This body movement servo 12 has three times the torque as a standard duty servo. This is necessary because moving the rider 8 from a low fulcrum situation takes power. The body movement servo 12 is attached to the roto-wing 11 at the servo's 12 power shaft, which is connected to the flexible arm 31 that attaches to the leg connector 28 that connects about halfway between the rider's 8 ankle 13 and knee. This low center of gravity connection is operating a high center of gravity object. The rider 8 which is basically light weight, still demands high torque power to move it, especially when the surfboard 10 and rider 8 are knocked down by a wave at a horizontal plane to the sky. The load on the body movement servo 12 at this point is tremendous. The servo 12 extends out from the deck 19 and is exposed to the elements; so it has to be waterproofed at all seams and openings especially at the power shaft. The servo 12 should have an "O" ring inside at the power shaft opening. The final waterproofing is done by a grease reservoir 29 which surrounds the power shaft with waterproof grease.

The rider's 8 right foot 16 and left foot 9 are attached in two different ways. The right foot 16 is attached towards the rear of the board 10 and is solidly anchored and waterproofed. The left foot 9 is attached by a swivel connector due to the awkward angle of the rider's 8 leg due to the crouched stance. This swiveling of the left foot 9 alleviates any binding up of the leg connector 28 and flexible arm 31 and allows for free flow of movement The other factors that help free movement are that the right amount of flex built into the flexible arm 31 and the swiveling attachments of the leg connector 28 both at the rider's 8 leg and the flexible arm 31 junction.

Also shown, are the two strings 24 and 25 starting at the roto-wing 11 at the port 26 and starboard 27 stop knots, extending out through the port 20 (not shown) and starboard 22 waist guides, then up and tied to the centered arm loop 23. The strings 24 and 25 are made of clear fishing line which are virtually invisible from a ten foot distance.

FIG. 2

Figures 2, 3, 4:
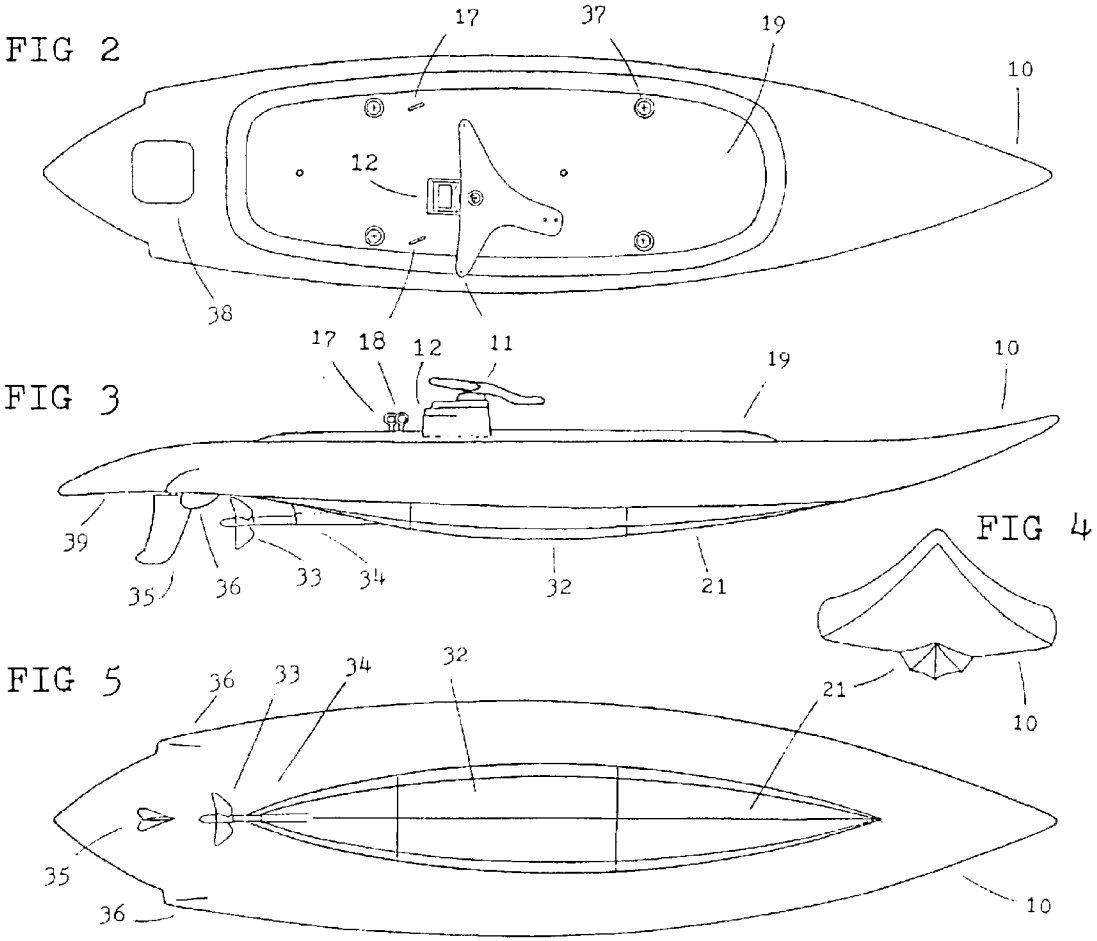
FIG. 2 is a top view of the surfboard deck and hull without the rider
FIG. 3 is a side view of the surfboard hull and deck and keelson without the rider
FIG. 4 is a front view of the surfboard hull and keelson

FIG. 2 shows a top view of the radio-controlled surfboard 10 without the rider 8. The waterproof deck 19 is shown fastened down by four deck screws 37. A top view of the body movement servo 12 connected to the roto-wing 11 reveals the outline shape of the roto-wing 11 which further reveals that the body movements branch is noticeably offset to starboard to accommodate the rider's 8 regular foot stance and crouched lower body 14. Also seen on the roto-wing 11 are the two open holes where the two strings (shown in FIG. 1) 24 and 25 are tied into stop knots 26 and 27 that connect to the roto-wing 11, that travel through the port 17 and starboard 18 deck guide then out to the rider 8. Also seen is a top view of the rudder hatch 38 in place. The outline shape of the surfboard 10 is revealed showing the wide winged tail design that planes up easier in order to carry the big battery weight around.

FIG. 3

FIG. 3. shows a side view of the radio-controlled surfboard 10 without a rider 8. The waterproof deck 19 is fastened down revealing the crown built into the deck for rigidity. Protruding out of the deck 19 is the body movement servo 12 attached to the roto-wing 11. Notice how the side view of the roto-wing shows that the body movement branch has a step down platform to accommodate the flex arm 31 attachment to the crouched angle leg. Also seen are the port 17 and starboard 18 deck guides. FIG. 3 also shows a good side line view of the radio controlled surfboard 10 and how the water flows by it. The up turned nose gives way to some flat running surface as well as the forward part of the keelson 21. A look at FIG. 4 helps to understand how water travels over the curved V-bottomed keelson at the same time that it travels over the flat planning surface of the surfboard 10. As the water travels aft, it goes by more flat surface as well as the deepest part of the keelson 21, which also doubles as a heat sink 32 and disbursement device to expel heat out of the motor room. The water travels past the aluminum heat sink up towards the end of the keelson 21 and into the propeller's 33 spin. The propeller's 33 spin shoots water up into a slightly concaved area as it passes by the rudder 35 and side fins 36 then out past the down turned tail 39. Besides propelling the radio controlled board 10 forward; the propellers 33 prop wash gives the tail lift as it travels into the flat, slightly concave area widened by the tail wings which host the side fins 36. The down turned tail 39 has the final act in creating tail lift. Tail lift is necessary to counter the horizontally mounted prop shaft 34 and the seven c-cell motor battery pack 51 which tends to hinder lift. Tail lift keeps the nose down and helps get the board upon plane sooner.

FIG. 4

FIG. 4 shows a front view of the radio-controlled surfboard 10. The underside of the upturned nose is seen as well as the V-bottomed keelson 21 part of this keelson design is derived from the V-bottomed fuselage and outboard sponsons from world war II seaplanes. The V-bottom provides lift, directional control, and chop absorption. The name keelson describes a semi keel, somewhere between a keel and a sponson. This keelson 21 was designed in as low a profile as possible to make this radio controlled surfboard 10 act like a planning hull, yet still contain motor room components within that doubles as ballast. The righting moment built into this radio controlled surfboard 10 is remarkably quick at righting it self considering how small the keelson 21 looks. This in part is attributed to the aluminum heat sink 32 fitted into the keelson 21 design that allows weight to be placed at the lowest possible part of the keelson 21.

FIG. 5

FIG. 5 shows a bottom view of the radio-controlled surfboard 10. The outline shape of the surfboard 10 is revealed showing the wide winged tail design that accommodates the semi-concaved area between the side fins 36 rudder 35 and propeller 33. The widest part of the surfboard 10 is at the rider's 8 front foot 9 which puts the bulk of the rider's 8 weight aft of the wide point of the surfboard 10. This was also outlined in Derrah '88 patent. However, this new surfboard's 10 wide point forward is a lot less exaggerated as it tapers towards the tail 39.

The outline shape of the keelson 21 is seen along with the raised V-bottom lines. This shape allows the water to flow back into the prop 33. Also shown is how much aluminum surface of the heat sink 32 shows up on the bottom of the surfboard 10.

FIG. 6

Figure 6:
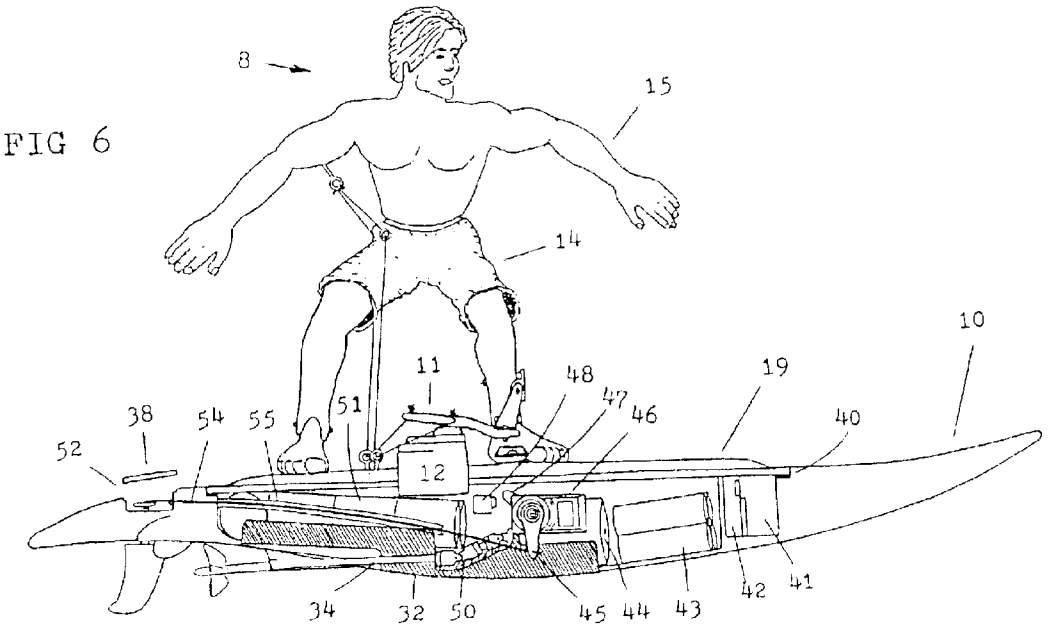
FIG. 6 is a cross sectional view of the surfboard hull with the robotic rider on top

FIG. 6 shows a front view of the moveable rider 8 and a starboard side view of the radio-controlled surfboard 10 that has a see through side so all interior components can be seen. The waterproof deck is shown screwed down compressing the sponge gasket 40. The receiver dry bay 42 is shown housing the radio receiver 41 high and dry away from the motor room. If the radio-controlled surfboard 10 did happen to take in water it could continue to run as long as both battery packs 43 and 51, both servos 46 and 49 as well as the on/off switch 48 and all the electrical connections in the motor room should be water proofed as well.

The most likely culprit for incoming water is through the prop shaft stuffing tube 34 due to it being improperly stuffed. This can be avoided by injecting the quick fill grease fitting (not shown) before each days use. The rudder servo 46 is shown at mid-ships with the servo arm 45 connected to the steering shaft 54 which travels through the steering prop staff stuffing tube 34 through the foam filled surfboard 10 out into rudder bay past the waterproof nipple 53 and connected to the rudder control arm 52 which moves the rudder post and rudder 35. Also shown is the motor servo arm 47 next to the on/off switch 48, which does not create any extra heat to run the motor; in comparison to a speed control that does. Notice the prop shaft and stuffing tube 34 are at an almost dead horizontal line into the keelson 21 through the heat sink 32 ballast; connected to the universal linkage 50 which is necessary to step up to the motor's 44 power shaft. The electrical motor 44 is mounted on the aluminum heat sink 32, which actually has four functions; it is a motor mount, a battery tray, a heat sink, and a low profile ballast keel. The body movement servo 12 is placed directly over the motor battery pack 51. This is one of the three reasons the prop shaft stuffing tube 34 is so horizontally mounted. The first is to allow room for the body movement servo 12 and the motor battery pack 51, the second is to set the motor 44 as low as possible, the third is to set the motor battery pack 51 as low as possible. Having these components mounted to the aluminum heat sink 32 allow for a quickened righting moment, eliminating the need to place lead weights in the keelson 21.

FIG. 7

Figure 7:
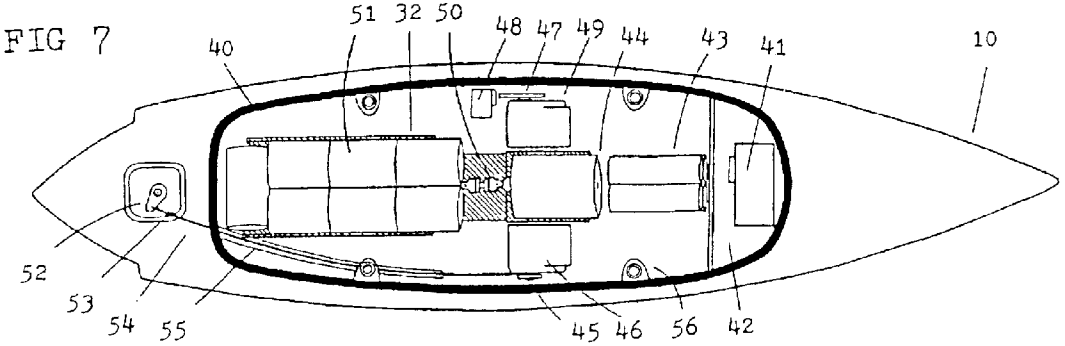
FIG. 7 is an interior view of the surfboard hull

FIG. 7 shows an overhead view of the radio-controlled surfboard 10 with the waterproof deck 19 removed along with the rider 8 the body movement servo 12 and the roto-wing 11. The components are place neatly inside the radio-controlled surfboard 10. All the heaviest units, the motor battery pack 51, the electric motor 44, the servo battery pack 43, and the heat sink 32 are all placed in line and inside or partially inside the keelson 21. This keeps the center of gravity low and centered. The lighter units such as the motor servo 49 and the rudder servo 46 are placed evenly across from each other for balance.

The receiver 41 can be seen in its dry bay 42. The entire sponge gasket 40 is revealed along with the four threaded deck mounts 56. The rudder hatch is removed to show a top view of the rudder control arm 52 and the waterproof nipple 53.

FIG. 8

Figure 8:
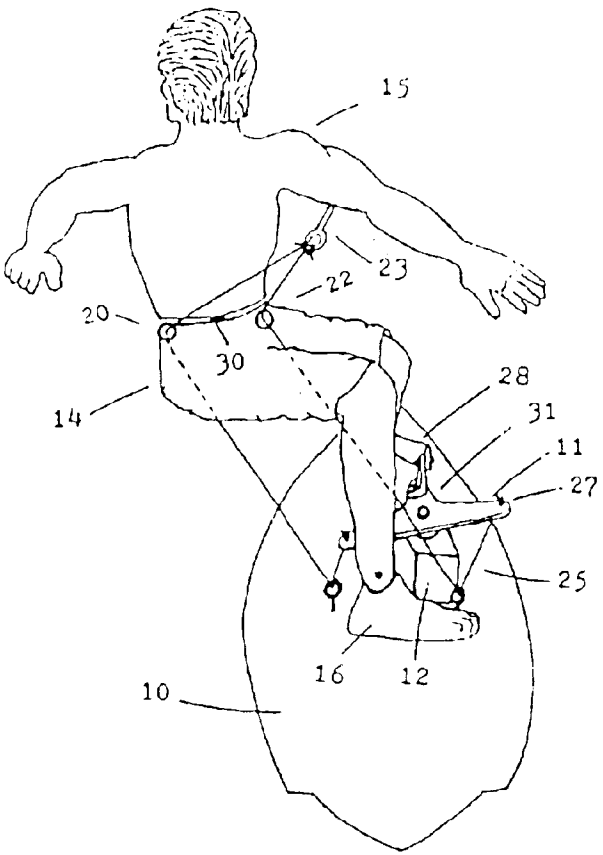
FIG. 8 is a view of the robotic rider on the surfboard in a left hand turn

FIG. 8 shows the rider 8 in a full backhand turning position. The rider's 8 body is leaned out over the port side of the surfboard 10 deck. This takes place by the servo 12 rotating to the left, which moves the servo roto-wing 11 body movement branch combination which connects to the flexible arm 31. The flexible arm 31 moves the leg connector 28 which attaches to the left leg, which moves the lower body 14 from port to starboard or vice versa. The leg connector 28 and flex arm 31 are made to swivel and flex to accommodate the back and forth, up and down movements of the lower body 14. This lower body 14 movement was outlined in Derrah '88 patent and is known as body movement #1. Body movement #2 is where the two string roto-wing 11 comes into this novel invention. Body movement #2 is the upper torso 15 twisting that reacts in-sync with body movement #1.

The two string pulling action can be seen when the port string 24 length between the port deck guide 17 and the port knot 26 is shorter that the starboard string 25 is between the starboard deck guide and the starboard knot 27. This creates an opposite effect at the upper torso 15 end of the strings 24 and 25. The distance between the starboard guide 22 and the arm loop 23 is shorter that the distance between the port guide 20 and the arm loop 23. The shorter string length between the waist guides 22 and 20 and the arm loop 23 is the one being pulled and in turn twists the torso in one direction. While the other string just lays loose.

FIG. 9

Figure 9:
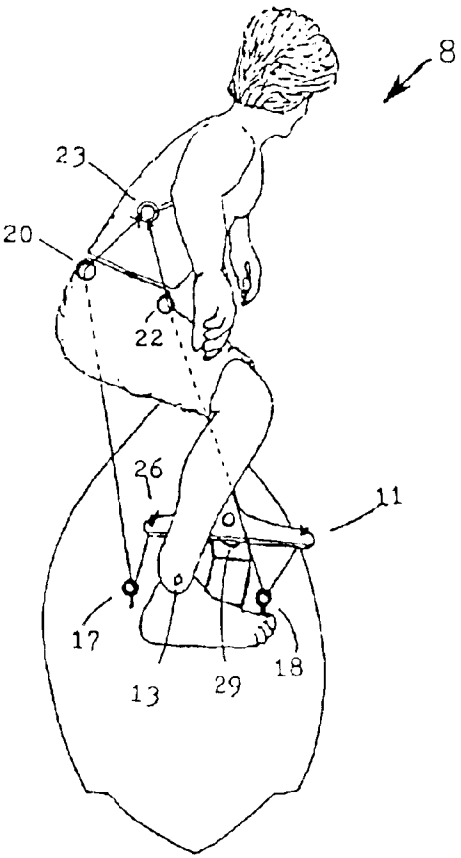
FIG. 9 is a view of the robotic rider on the surfboard in a go straight position

FIG. 9 shows the rider in a center balanced, straight ahead steering stance. Notice the string lengths of the port deck guide 17 and starboard deck guide 18 between the port 26 and starboard 27 string knots are equal. Also the string lengths between both waist guides 20 and 22 and arm loops 23 are equal.

FIG. 10

Figure 10:
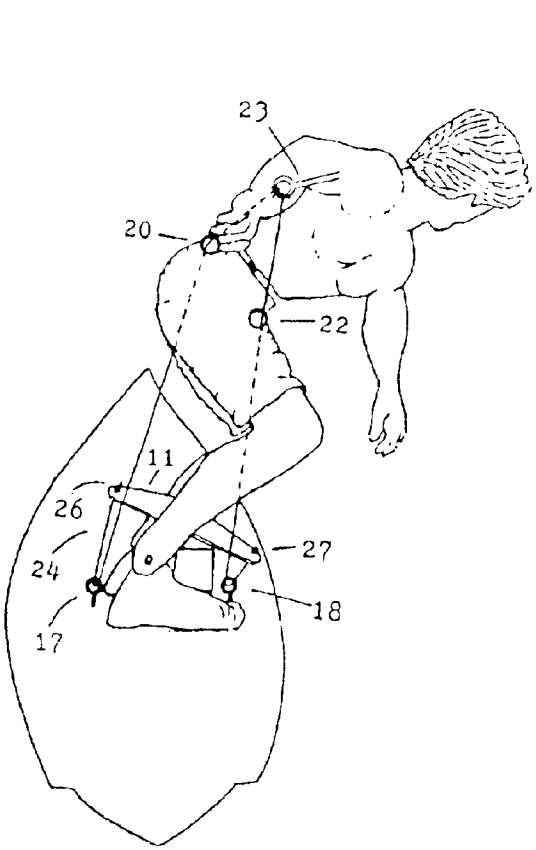
FIG. 10 is a view of the robotic rider on the surfboard in a right hand turn

FIG. 10 shows the rider 8 in a full front hand turning position. The rider's 8 lower body 14 and upper torso 15 are leaned out over the starboard side of the surfboard 10 as well as twisted in the direction of the turn. The string lengths are opposite from the lengths shown in FIG. 8, also the rotation of the roto wing 11 is different. The distance between port guide 20 and arm loop 23 is the shortest and pulled directly under arm loop 23 on a vertical plane. This demonstrates that the position of the two waist guides 20 and 22 which are the closest to the arm loop 23 can determine how much rotational twisting the upper torso 15 can be achieved. As long as there is plenty of servo 12 rotation and roto-wing 11 swing to feed and retract sufficient lengths of line. The roto-wing swing can be increased by increasing the roto-wing 11 span, and also increased servo 12 rotation.

What is claimed is:

1. A radio controlled steerable self-propelled surfboard toy capable of moving on water comprised of:

a posed robotic rider with a light upper body and an attached lower body;

a motorized self propelled surfboard having a hull with sufficient buoyancy to keep the surfboard afloat on water, and having a general longitudinal axis, said surfboard having an upper surface said upper surface supporting said robotic rider and an under surface;

a keelson molded to said under surface;

a heat sink fitted into said keelson capable of transferring heat from an interior area of the hull to outside surroundings;

a variable speed motor enclosed in said hull;

a power source operatively connected to the motor;

a radio wave signal allows an operator to continuously and differentially vary, at an operator's option any level of power supplied from the power source to the motor;

a steering system which combines rudder movements turning in sync with movements of the upper and lower body of the robotic rider to shift weight of robotic rider from one side of the surfboard to another side of the surfboard by means of a two string roto-wing.

2. A radio controlled steerable self-propelled surfboard toy as claimed in claim 1 further comprising said posed robotic rider secured by one foot and pivotally attached by a second foot to said surfboard upper surface.

3. A radio controlled steerable self-propelled surfboard toy as claimed in claim 1 wherein said keelson assists in recovery of said surfboard to right said surfboard toy.

4. A radio controlled steerable surfboard toy as claimed in claim 1 wherein the radio wave signal is transmitted by an operator at a remote location from the surfboard, and a signal receiving means is incorporated in the surfboard and operatively associated with the power source and with the motor and the signal receiving means receives the radio wave signal and applyies power to the motor in conformance to the radio wave signal.

5. A radio controlled steerable surfboard toy according to claim 4 wherein a steering system makes the upper body of the robotic rider rotate to move in the same turning direction as the surfboard by means of pulling on one of two strings of the two string roto-wing.

6. A radio controlled steerable surfboard toy according to claim 1 wherein the upper surface is water proof by means of a sponge gasket and securing screws.

7. A radio controlled steerable surfboard toy according to claim 1 having a small centered rudder and two towed-in side fins on the under surface of said surfboard.

8. A radio controlled steerable surfboard toy according to claim 1 wherein having a flat semi concave prop wash area and a down turned tail on said under surface of said surfboard.

9. A radio controlled steerable surfboard toy according to claim 4 having two servos for steering working in sync via a "Y" shaped harness allowing both servos to receive simultaneous command signals.

10. A radio controlled steerable self-propelled surfboard toy according to claim 1 having a high torque body movement servo that is water proofed by a grease reservoir at a powershaft.

* * * * *